United States Patent [19]

Laughlin

[11] 4,152,842

[45] May 8, 1979

[54] DEHYDRATOR

[75] Inventor: David E. Laughlin, Green River, Wyo.

[73] Assignee: Laughlin Enterprises, Salt Lake City, Utah

[21] Appl. No.: 821,830

[22] Filed: Aug. 4, 1977

[51] Int. Cl.[2] ..... F26B 9/06

[52] U.S. Cl. ..... 34/196; 34/197; 99/474; 219/400

[58] Field of Search ..... 34/197, 196, 233; 99/468, 474, 476, 487; 219/400

[56] References Cited

U.S. PATENT DOCUMENTS

| | | | |
|---|---|---|---|
| 1,228,283 | 5/1917 | Beckworth et al. | 34/17 |
| 1,293,799 | 2/1919 | King | 34/197 |
| 1,507,719 | 9/1924 | Ritchie | 34/197 |
| 1,542,616 | 6/1925 | Green | 34/197 |
| 1,552,210 | 9/1925 | Bussler | 34/197 |
| 2,120,471 | 6/1938 | Peters et al. | 34/53 |
| 3,943,842 | 3/1976 | Bills et al. | 34/197 |

FOREIGN PATENT DOCUMENTS

| | | | |
|---|---|---|---|
| 335512 | 12/1972 | U.S.S.R. | 34/53 |

*Primary Examiner*—John J. Camby
*Assistant Examiner*—Larry I. Schwartz
*Attorney, Agent, or Firm*—Marcus G. Theodore

[57] ABSTRACT

A cabinet dehydrator for home preservation of food under relative humidity, pressure, and temperature restraints. Intake air is obtained from the surrounding atmosphere and displaced into the dehydrator over heating elements by a blower. This heated air is ported through a manifold defined by the cabinet walls having a sloping chamber which narrows toward the top of the cabinet to evenly displace the heated air over the tops of removable drying trays. The heated air withdraws moisture from the articles of food placed on the drying trays, and is partially exhausted through exhaust portals, depending upon the relative humidity, temperature, and pressure of the surrounding atmosphere. The remaining heated air is mixed with an amount of surrounding air entering through intake portals to replace the amount exhausted. This mixture of heated air and intake air is then heated and recirculated by the blower until the articles of food are dried.

9 Claims, 2 Drawing Figures

DEHYDRATOR

BACKGROUND

1. Field of Invention

The present invention relates generally to the dehydration of foods, and more particularly to a novel dehydrator and method for home preservation of food under relative humidity, pressure, temperature, and air flow restraints.

2. State of the Art

In the various types of dehydrators described in the literature, or in present use, the drying or dehydrating of food products is accomplished through the use of sun drying, kitchen oven drying, and special equipment drying. Special equipment drying involves apparatuses which contain controls to regulate blower speeds, the temperature, humidity, and pressure of influent air, and the size of the apertures for influent and effluent air. Examples of these inventions are found in the following U.S. Pat. Nos.: 3,943,842 issued Mar. 16, 1976 to J. P. Bills and E. L. France; 3,362,081 issued Jan. 9, 1968 to E. F. Bogenberger; 2,464,573 issued Mar. 15, 1949 to G. Helm; 1,552,210 issued Sept. 1, 1925 to M. E. Bussler; 3,359,644 issued Dec. 26, 1967 to M. S. Goldman; 2,464,706 issued Mar. 15, 1949 to C. T. McGraw; 2,642,860 issued June 23, 1953 to H. T. Hunter et. al.; 2,357,946 issued Sept. 12, 1944 to E. I. Fuller; and 2,412,407 issued Dec. 10, 1946 to P. D. Kilbury. There remains a need for an invention of special drying equipment which eliminates the necessity of varying the blower speed, the size of the apertures for influent and effluent air, and the relative humidity, and pressure of the influent air; thereby minimizing manufacturing costs to make the invention available to a broad home market. The present invention fulfills that need.

BRIEF SUMMARY OF THE INVENTION

The present invention comprises a novel home dehydrator comprising a rigid housing with a blower; a heat chamber to heat influent air forced into the heat chamber by the blower; a manifold defined by the cabinet walls and the front edges of the drying trays for displacing the heated air exiting the heat chamber evenly in contiguous relation with food placed upon removable drying trays, and thereafter recirculating and exhausting the heated air; and controls to vary the temperature of the heated air within a suitable range to efficiently dehydrate, without excessive vitamin loss, the food placed therein.

DETAILED DESCRIPTION OF THE ILLUSTRATED EMBODIMENTS

Figure 1:
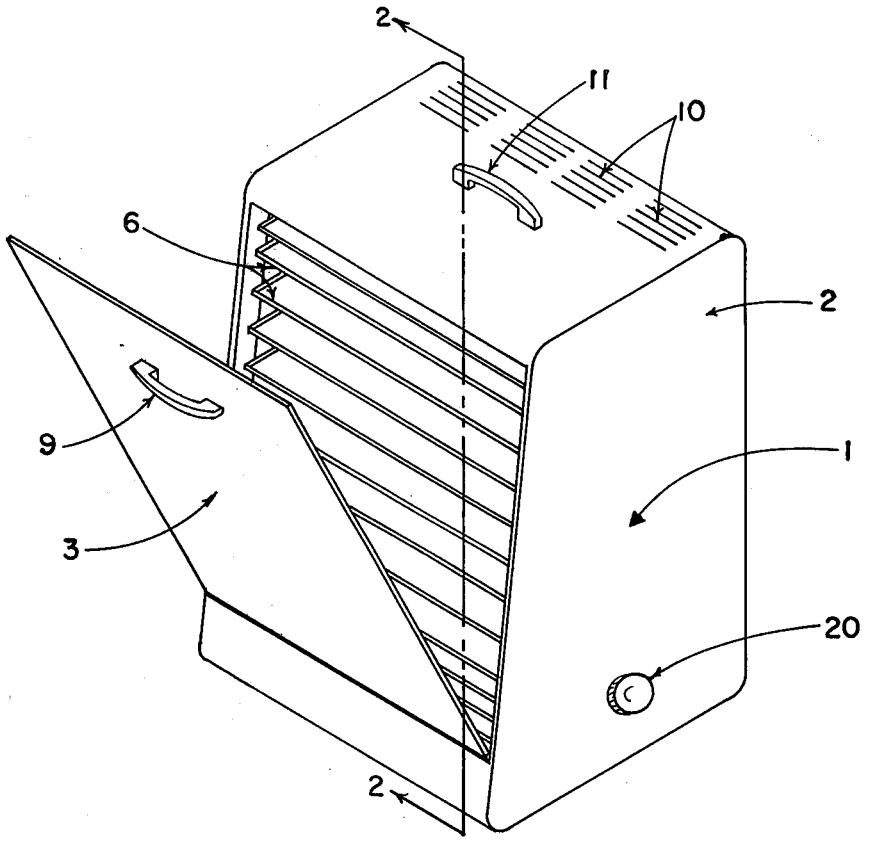
FIG. 1 is a perspective representation of one presently preferred dehydrator embodiment of the present invention

Referring to the drawings, in FIG. 1 the numeral 1 designates generally the improved dehydrator wherein a cabinet 2 having a food access door 3 houses a blower 4 to circulate influent air, heated in a heat chamber 5, over removable drying trays 6 for holding articles of food, and then over a thermostat 7, which regulates the heat chamber 5; and wherein the improvement comprises a manifold 8 defined by the cabinet walls and the front edges of the drying trays having a sloping chamber which narrows toward the top of the cabinet 2 to evenly displace the heated air circulated by the blower 4 over the tops of all the drying trays 6, and eventually out of the dehydrator 1 after being recirculated a number of times, depending upon the relative temperature, pressure, and humidity of the surrounding atmosphere.

Specifically, in FIG. 1, the dehydrator 1 is comprised of a cabinet 2 with a sloping front having an airtight hinged food access door 3 opening through the aid of a door handle 9. The top of the cabinet 2 contains a plurality of exhaust portals 10, and has a carrying handle 11 attached. The bottom of the cabinet 2 is supported by a plurality of legs 12, and contains a plurality of intake portals 13. The dimensions of the cabinet 2 are labeled in alphabetical letters in FIG. 2, which is a cross section side view of the device taken along the lines 2—2. Because the dehydrator 1 can be built to accommodate more or less removable drying trays 6 than the number illustrated in FIG. 1, the configuration of the cabinet 2 dimensions labeled in FIG. 2 can be varied within the following approximate ranges or the equivalent ratios thereof, as the number and widths of the drying trays is altered $D1-0.5$ in. (1.27 cm.)$=r\times N$, where $r=0.19\pm0.1$ in. ($0.48\pm0.25$ cm.), and $N$=number of removable drying trays 6 of width D4;

$D2=0.5\pm0.5$ in. ($1.27\pm1.27$ cm.);

$D3=m\times N$, where $m=0.15\pm0.1$ in. ($0.37\pm0.25$ cm.);

$D4=11$ in. $+11$ in., $-4.0$ in. (28 cm. $+28$ cm., $-5.1$ cm);

$S1=2.0\pm1.0$ in. ($5.1\pm2.5$ cm.);

$ST=1.5$ in. $+2.0$ in., $-1.0$ in. (3.8 cm. $+5.1$ cm., $-2.5$ cm.);

$H=(N-1)ST+S1$.

Factors which give particularly good results other than those stated above are $m=0.15\pm0.1$ in ($0.37\pm0.25$ cm.), and $r=0.20\pm0.10$ in. (0.48 cm$\pm0.25$ cm.).

Attached to the bottom of the cabinet 2 is a blower 4 comprised of a motor 14 and fan 15. Mounted to the sides of the cabinet 2, above the motor 14, is a heat chamber 4. The bottom of the heat chamber 4 is curved along the front of cabinet 2 to direct air through an opening along the length of the top of the heat chamber 4 parallel to the front of the cabinet 2. The heat chamber 4 is mounted to the front of the cabinet 2 to leave an opening D3 between the rear of the heat chamber 4 and the back of the cabinet 2.

Figure 2:
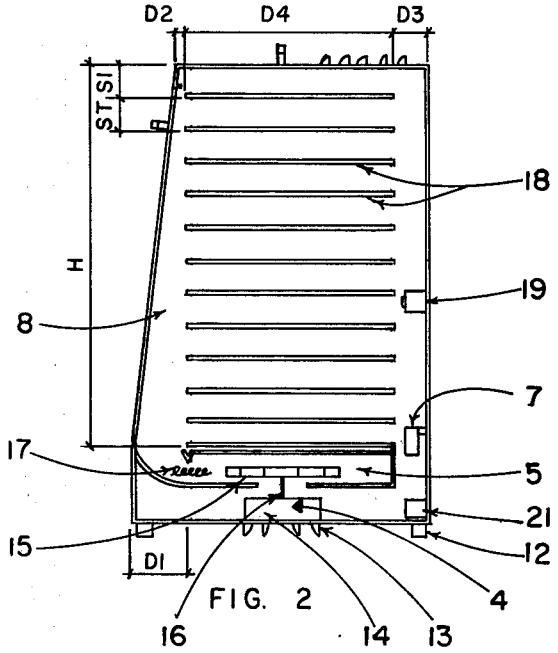
FIG. 2 is a cross section side view of the dehydrator shown in FIG. 1 taken along the lines 2—2.

The bottom of the heat chamber 4 contains a plurality of portals to admit heated air, and a hole for the shaft 16 of the motor 14. Attached to the shaft 16 is a fan 14, which turns within the heat chamber 4, and is surrounded by a heating element 17. The power density of the heating element 17 and motor 14 are approximately 0.5 watts/in.$^2$, which is derived by dividing the total energy delivered by the heating element 17 and motor 14 by the total area of the tops of all the drying trays 6. The fan 14 generates a flow velocity of approximately 4 ft./sec. to 6.5 ft./sec. over the tops of the drying trays 6 when loaded with articles of food between $\frac{3}{8}$ to $\frac{5}{8}$ inch thick. The flow velocity is derived by dividing the fan 15 output in cfm. by the cross-sectional area of the cabinet 2 minus the area of the front edges of all drying trays 6 and the cross sectional area below the bottom drying tray 6. Although a motor 14 and a fan 15 are illustrated in FIG. 2, any blower apparatus generating the flow velocity specified could be used with the dehydrator 1. Examples of blowers 4 which give particularly good results are those which generate a flow velocity of 4.04 ft./sec. to 6.36 ft./sec. over the tops of the drying trays 6, when loaded with food articles of the size specified above.

Mounted to the back of the cabinet 2, near the opening between the back of the heat chamber 4 and the back of the cabinet 2, is a thermostat 7 to regulate the output of the heating element 7. The thermostat is designed to regulate the temperature of the return air between 110° F. and 170° F.

Affixed to the sides of the cabinet 2, above the heat chamber 4, are parallel lateral supports 18 on which the drying trays 6 are held by gravity. The distance between the top lateral supports 18 and the top of the cabinet 2 is represented by S1 in FIG. 2. The distance between the lateral supports 18 is represented by ST in FIG. 2.

When the drying trays 6 are placed on the lateral supports 18, a manifold 8 having an unobstructed sloping air space with cross-sectional dimensions $D2 \times H \times D1 \times H'$, where H' equals $[H^2+(D1-D2)^2]^{\frac{1}{2}}$, shown in FIG. 2, is created between the front of the cabinet 2, and the front edges of the drying trays 6. Air blown by the fan 14 passes through the opening in the top of the heat chamber 4, enters the manifold, and is uniformly distributed over the drying trays 6 to draw moisture from the articles of food placed on the drying trays 6.

After passing over the drying trays 6, a small amount of humidified air, depending upon the relative humidity, pressure, and temperature of the surrounding atmosphere, is bled off through the exhaust portals 10. The remainder of the humidified air is collected in the rectangular cross-sectional air space between the back of the cabinet 2 and the back edges of the drying trays 6. This collected humidified air then passes over the thermostat 7, and enters a mixing chamber between the heat chamber 4 and the bottom of the cabinet 2. In the mixing chamber the humidified air is mixed with atmospheric air entering through intake portals 13 to replace the amount of humidified air bled off through the exhaust portals 10. This air mixture is then forced into the heat chamber 4 through a plurality of portals in the bottom of the heat chamber 4 by the action of the fan 15. After entering the heat chamber 4, the air mixture is heated by the heating element 17, and then recirculated throughout the cabinet 2 as described above.

Optional elements which can be used with the dehydrator 2, are shown in FIG. 2. A humidistat 19 is mounted to the back wall of the dehydrator 2 exposed to the return air. The humidistat 19 shuts down the power input to the dehydrator 2 heating element 17, and blower 4, when the relative humidity of the return air is between 1% and 3%. Also shown in FIG. 2 is an optional thermal overload switch 21 mounted to the base of the dehydrator 2, which interrupts the power supply to the dehydrator 2 in the event the blower 4 fails.

FIG. 1 illustrates another optional element which can be used with the dehydrator 2. An adjustable timer 20 is mounted to the wall of the dehydrator 2 to terminate the operation of the dehydrator 2, after a pre-set time selected by the user has lapsed.

What is claimed and desired to be secured by United States Letters Patent is:

1. In a dehydrator of the type including a chamber containing:

(a) a plurality of horizontal drying trays spaced vertically within, in operable association with (b) a blower adapted to continuously draw into a lower zone of the chamber make up air which replaces a portion of exhausted air displaced out of the chamber through non-variable exhaust portals, depending upon the relative temperature, humidity, and pressure of the ambient air; where it is blended with recirculating air which was drawn into the lower zone of the chamber by the blower from a rear zone of the chamber where the air flowing over the drying trays has collected;

(c) a heating element to heat an air mixture entering the lower zone of the chamber; and (d) a thermostat to regulate the heating element; the improvement comprising, (e) enclosing the chamber with a cabinet having a trapezoidal shape, with a bottom, top, and sidewalls, including a sloping sidewall around said plurality of trays to form a frontal zone within said chamber having a relatively large horizontal cross section in the vicinity of the lower most tray and progressively decreasing horizontal cross sections in the vicinities of each succeeding tray vertically upward within the cabinet so that the heated air mixture expelled from the lower zone by the blower is forced to flow in substantially uniform amounts across the top of each said drying tray.

2. A dehydrator according to claim 1, wherein the dimensions of the cabinet are within the following approximate ranges, or the equivalent ratios thereof, as the number and widths of the drying trays are altered:

(a) the depth of the top of the cabinet equals D2+D3+D4, where $D2=0.50\pm0.50$ in. ($1.3\pm1.3$ cm.); $D3=m\times N$, where $m=0.15\pm0.10$ in. ($0.37\pm0.35$ cm.); and $N$=number of drying trays of width D4, where $D4=11$ in.$+11$ in., $-4$ in. (28 cm.$+28$ cm., $-5.1$ cm.);

(b) the depth of the bottom of the cabinet equals D1+D3+D4, where $D1-0.50$ in. (1.27 cm.)$=r\times N$, and $r=0.20\pm0.10$ in.;

(c) the distance between the top drying tray and the top of the cabinet equals S1, where S1 equals $2.0\pm1.0$ in. ($5.1$ cm.$\pm2.5$ cm.);

(d) the distance between the drying trays equals ST, where $ST=1.5$ in.$+2.0$ in., $-1.0$ in. (3.8 cm.$+5.1$ cm., $-2.5$ cm.); and (e) the distance between the top of the cabinet and the top of the bottom drying tray equals H, where $H=(N-1)ST+S1$.

3. A dehydrator according to claim 1, wherein the blower speed is fixed, generating a flow velocity of approximately 4 ft./sec. to 6.5 ft./sec. over the tops of the drying trays when loaded with articles of food between $\frac{3}{8}$ in. to $\frac{5}{8}$ in. (0.95 cm. to 1.6 cm.) thick.

4. A dehydrator according to claim 1, wherein the heating element and motor have a power density of approximately 0.40 watts/in.$^2$ (0.06 watts/cm.$^2$).

5. A dehydrator according to claim 2, wherein the heating element and motor have a power density of approximately 0.40 watts/in.$^2$ (0.06 watts/cm.$^2$).

6. A dehydrator according to claim 5, wherein the blower speed is fixed, generating a flow velocity of approximately 4.0 ft./sec. to 6.5 ft./sec. over the tops of the drying trays when loaded with articles of food between $\frac{3}{8}$ to $\frac{5}{8}$ in. (0.95 cm. to 1.6 cm.) thick.

7. A dehydrator according to claim 6, wherein the heating element and the blower are controlled by a humidistat within the rear zone of the chamber to shut off the power input when the relative humidity of the recirculating air is between 1% and 3%.

8. A dehydrator according to claim 6, wherein the heating element and the blower are controlled by an adjustable timer to shut off the power input after a pre-set time period has elapsed.

9. A dehydrator according to claim 6, wherein the heating element and the blower are controlled by a thermally activated overload switch to shut off the power input in the event the blower fails.

* * * * *